US006050699A

United States Patent [19]

Bouffay et al.

[11] Patent Number: 6,050,699

[45] Date of Patent: Apr. 18, 2000

[54] PORTABLE ELECTRIC TORCH WITH ROTARY CYLINDER

[75] Inventors: Boris Bouffay, Grenoble; Paul Petzl, Barraux, both of France

[73] Assignee: ZEDEL, Crolles, France

[21] Appl. No.: 08/957,810

[22] Filed: Oct. 27, 1997

[30] Foreign Application Priority Data

Nov. 5, 1996 [FR] France ..... 96 13700

[51] Int. Cl.[7] ..... F21L 7/00

[52] U.S. Cl. ..... 362/203; 362/202; 362/188; 362/157

[58] Field of Search ..... 362/205, 187, 362/208, 155, 202, 183, 226, 189, 158; 200/60, 564, 162, 50.04; 240/10.66, 10.68; 429/97

[56] References Cited

U.S. PATENT DOCUMENTS

| | | | |
|---|---|---|---|
| 3,743,915 | 7/1973 | Struck | 320/2 |
| 3,835,272 | 9/1974 | Wisenbaker | 200/60 |
| 4,531,178 | 7/1985 | Uke | 362/158 |
| 4,577,263 | 3/1986 | Maglica | 362/187 |
| 4,709,309 | 11/1987 | Yamaki . | |

FOREIGN PATENT DOCUMENTS

| | | |
|---|---|---|
| A2 0-285349 | 10/1988 | European Pat. Off. . |
| 2-372382 | 6/1978 | France . |
| 2-513740 | 4/1983 | France . |

*Primary Examiner*—Sandra O'Shea
*Assistant Examiner*—Ismael Negron
*Attorney, Agent, or Firm*—Oliff & Berridge, PLC

[57] ABSTRACT

A torch light having a case containing batteries and an assembly formed by a bulb and connecting circuit arranged on a cylinder mounted with limited rotation in a circular housing of the case between a first rest position allowing access to the first compartment for fitting or removal of the batteries and a second work position commanding lighting of the torch. The cylinder has a ramp cooperating with the batteries when switching from the first rest position to the second work position takes place to allow the first contact and the second contact to come into engagement with the respective terminals of opposite polarities of said batteries. A pushbutton operating the switch is able to be in an inactive position corresponding to the closed state of the switch when the second contact is bearing against one of the terminals, and an active position urging the switch to the open state following separation of the terminal with the second contact.

9 Claims, 8 Drawing Sheets

PORTABLE ELECTRIC TORCH WITH ROTARY CYLINDER

BACKGROUND OF THE INVENTION

The invention relates to an electric torch light with a case containing:

- a direct current source comprising a plurality of batteries housed in a first compartment of the case,
- a connecting circuit for electrical connection of the bulb, comprising supply contacts electrically connected with the current source by means of a switch,
- and a visualization cover comprising a reflector associated with a transparent screen for emission of a light beam coming from the bulb in the energization phase.

Lighting lamps in the form of torches generally comprise tubular enclosures made of insulating or metallic material, having at the level of the base an orifice which can be blanked off by a closing end part. To put such a torch into operation, the terminal end part has to be removed, followed by insertion of the batteries via the base of the enclosure. Switching on and off of the bulb are then performed by means of an integrated switch, which is actuated by rotation of the ring when the latter reaches an end of travel position. The switch is formed either by a semi-stationary contact cooperating directly with one of the terminals of the bulb, or by a support part movable in limited translation inside the enclosure. The semi-stationary contact of the first device can be subjected to oxidation problems liable to cause bad contacts and lighting failures. The second known device is complicated and is generally used for torch lights with metallic enclosures.

SUMMARY OF THE INVENTION

The object of the invention is to achieve a torch light with reliable operation and of simplified construction.

The torch light according to the invention is characterized in that the bulb and the connecting circuit are arranged on a cylinder inserted in a circular housing at the front part of the case and movable in rotation between a first rest position allowing access to the first compartment for fitting or removal of the batteries, and a second work position to energize the bulb and block access to the first compartment. The cylinder advantageously comprises a ramp cooperating with the batteries when switching to the second position takes place to facilitate the coming into engagement of the first contact and the second contact with the respective terminals of opposite polarities of said batteries.

According to one feature of the invention, the cylinder comprises in addition a pushbutton operating the switch of the electrical connecting circuit, the pushbutton being able to be in an inactive position corresponding to the closed state of the switch when the second contact is bearing against one of the terminals, and an active position urging the switch to the open state following separation of the terminal with the second contact.

The reflector comprises a stop designed to move the pushbutton from the inactive position to the active position when the rotary ring of the cover reaches said extreme position.

According to a preferred embodiment, the first contact and the second contact of the connecting circuit are permanently in electrical connection respectively with the metallic base and the insulated terminal of the bulb. The pushbutton is arranged appreciably in axial alignment with the batteries placed under the second contact, and the second contact is provided with an orifice allowing the pushbutton to pass through when the latter is urged to the active position by the stop of the reflector.

The two contacts remain in permanent electrical connection with the bulb, and the switch function is shifted to a zone away from the bulb, with creation of an insulation distance between the second contact and one of the batteries.

According to one feature of the invention, the cylinder is formed by a cylindrical body made of molded insulating material, comprising a perforated intermediate wall separating the first rear compartment with the batteries from a second front compartment housing the bulb and reflector, the wall being provided with an opening allowing access to the first compartment in the first rest position of the cylinder and after the cover has been removed, and blocking access when the cylinder is moved to the second work position.

BRIEF DESCRIPTION OF THE DRAWINGS

Other advantages and features will become more clearly apparent from the following description of an embodiment of the invention, given as a non-restrictive example only, and represented in the accompanying drawings, in which.

DETAILED DESCRIPTION OF THE PREFERRED EMBODIMENT

Figure 1:
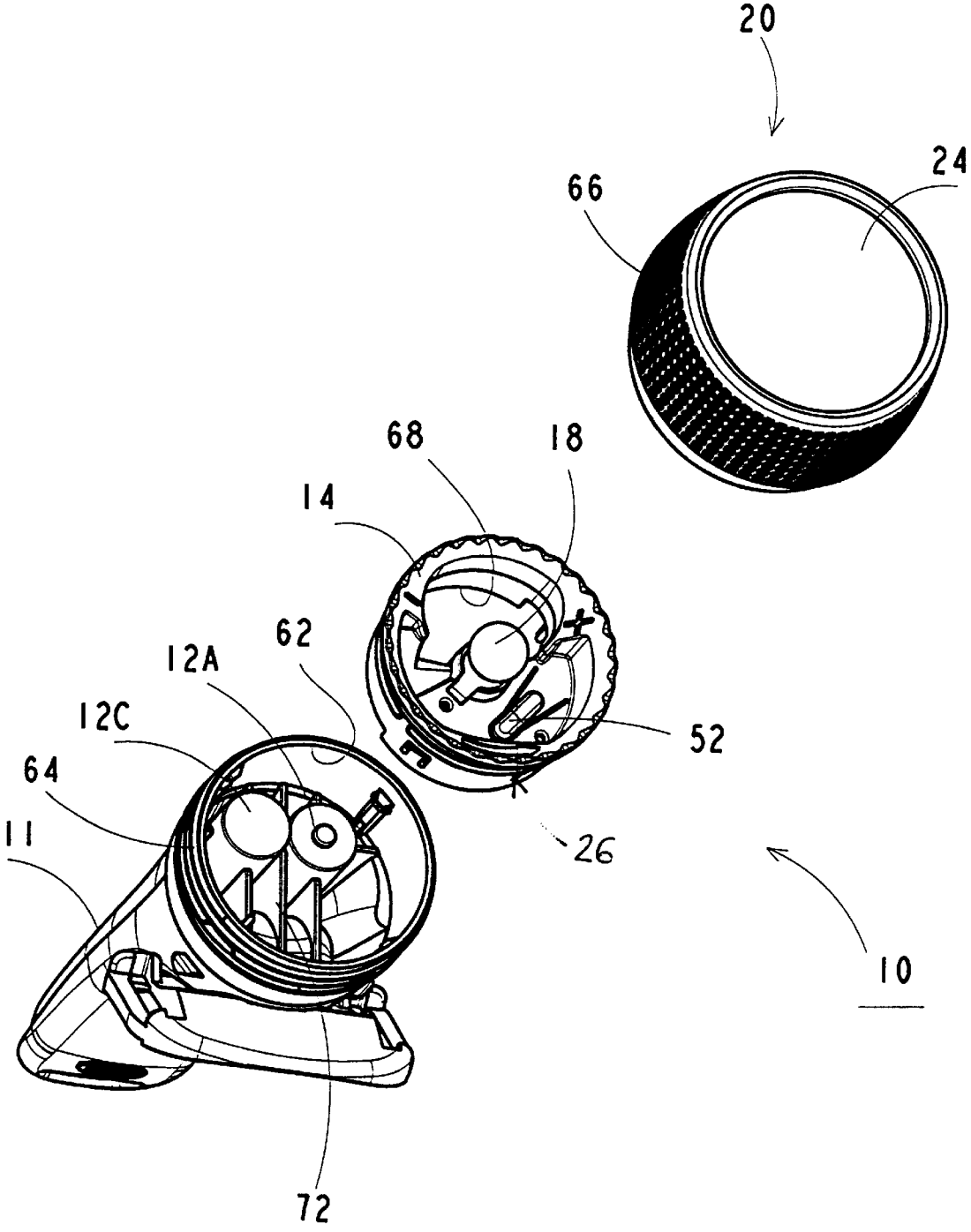
FIG. 1 is an exploded perspective view of the torch light according to the invention.

In the figures, an electric torch 10 comprises an elongate case 11 made of insulating material housing the batteries 12A, 12B; 12C, 12D, a cylinder 14 equipped with an electrical connection circuit of the bulb 18, and a visualization cover 20 comprising a reflector 22 and a transparent screen 24 for transmission of the light beam emitted by the bulb 18 when the latter is energized.

The cylinder 14 is formed by a cylindrical body 26 made of molded insulating material, comprising a perforated separating wall 28 designed to subdivide the inside of the case 11 into a first compartment 30 housing the batteries 12A, 12B, 12C, 12D and the connecting circuit 16, and a second compartment 32 housing the bulb 18 and reflector 22.

Figure 6:
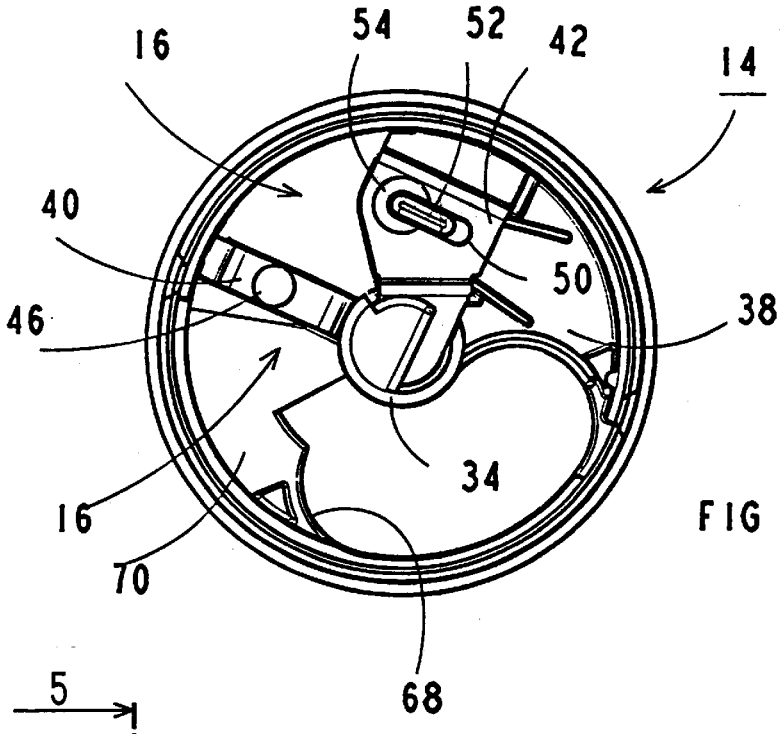
FIG. 6 shows the opposite face of the cylinder according to FIG. 4.
Figure 4:
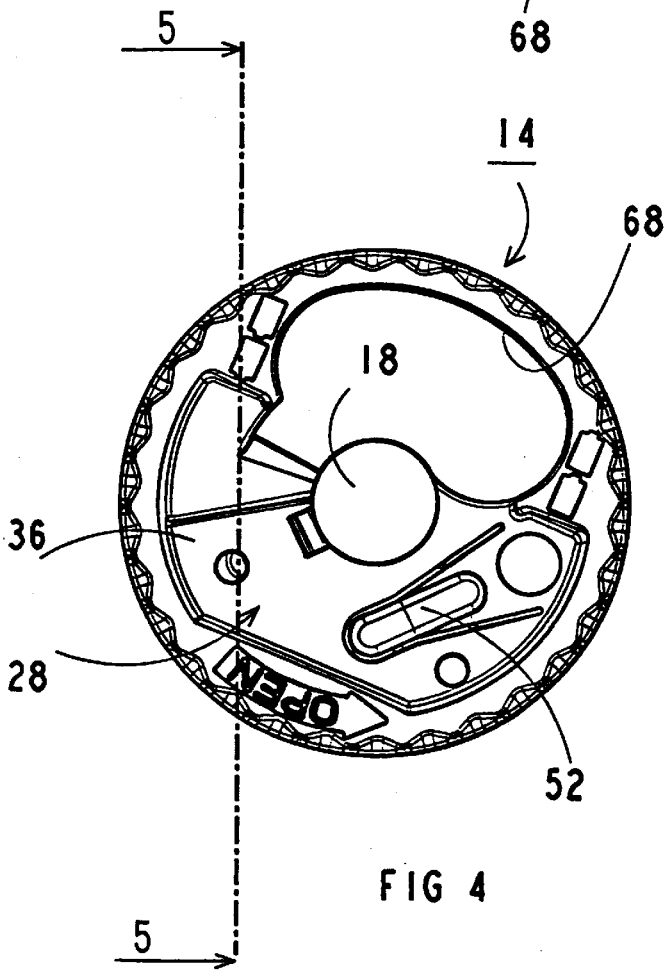
FIG. 4 represents a plan view of the cylinder equipped with the bulb.
Figure 5:
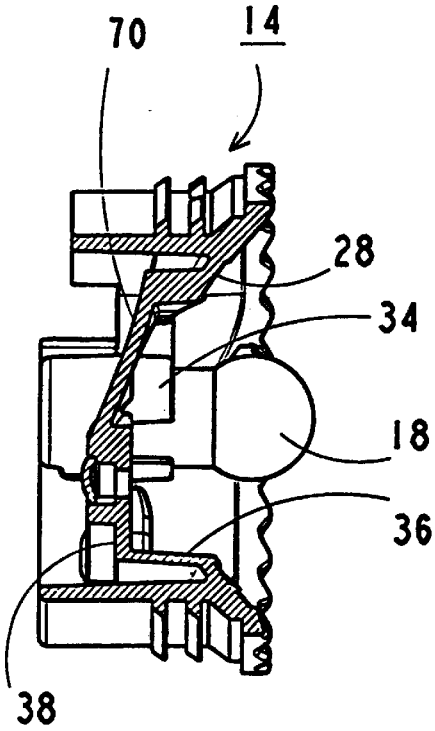
FIG. 5 is a cross-sectional view along the line 5—5 of FIG. 4.

With reference to FIGS. 4 to 6, the base of the bulb 18 is screwed into a tubular insulating socket 34 securedly affixed to one of the faces 36 of the wall 28. The other opposite face 38 of the wall 28 bears the connecting circuit 16, comprising a first supply contact 40 in permanent electrical connection with the metal base of the bulb 18, and a second supply contact 42 in permanent electrical connection with the insulated terminal 44 of the bulb 18.

Figure 8:
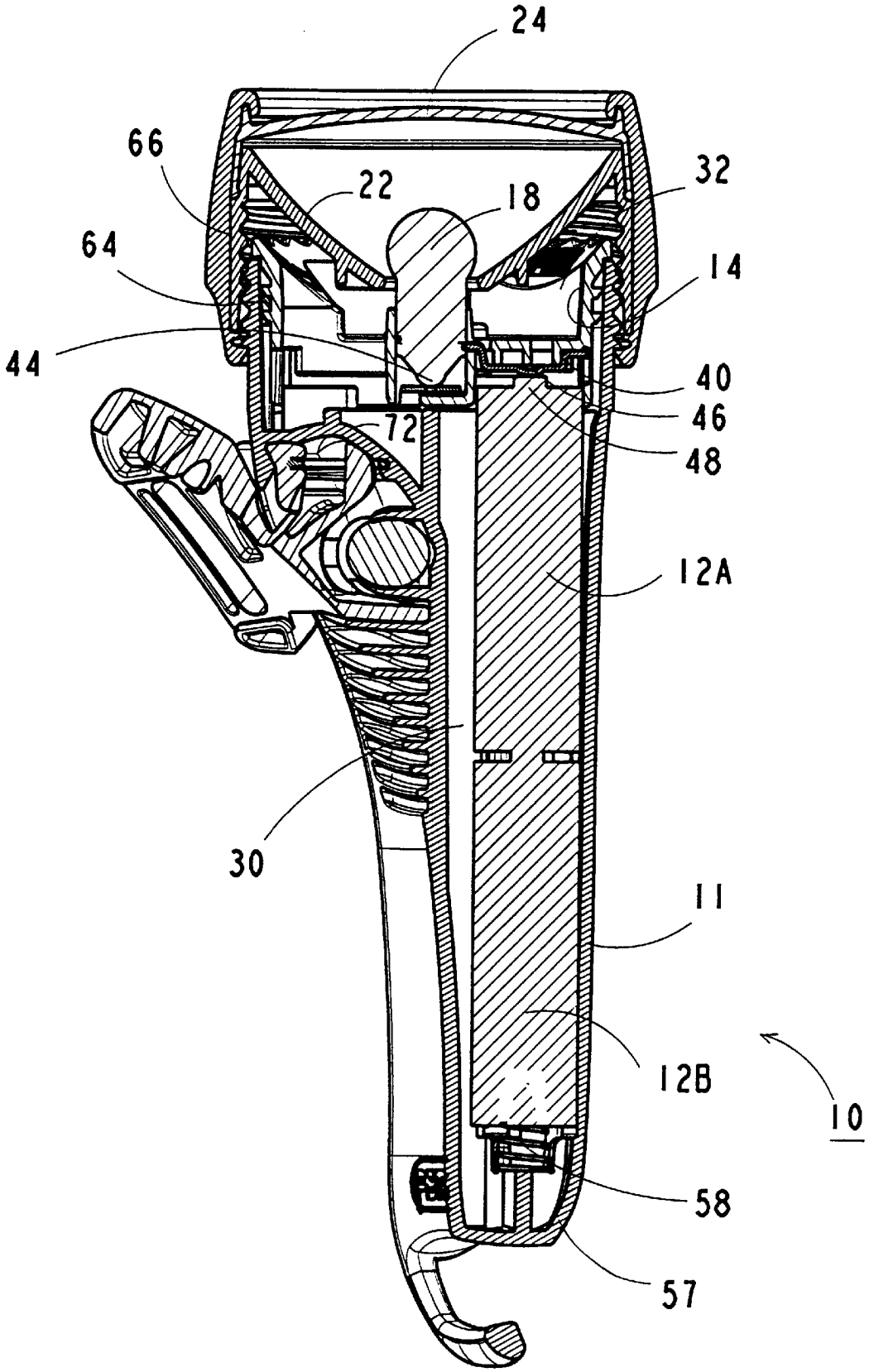
FIG. 8 is an identical view to FIG. 7 according to a cutting line passing through the first contact, and in the lit position of the bulb.

In FIGS. 6 and 8, the first contact 40 is formed by a copper strip of small thickness extending radially along the face 38 of the wall 28, and passing through the lateral surface of the socket 34 in such a way as to come into engagement with the base of the bulb 18. The material of the metallic strip can be copper, brass, bronze, or steel. The first contact 40 comprises in the middle zone a protuberance 46 designed to come into contact with the positive terminal 48 of a first series of two cylindrical batteries 12A, 12B stacked axially in a single column in the compartment 30.

Figure 7:
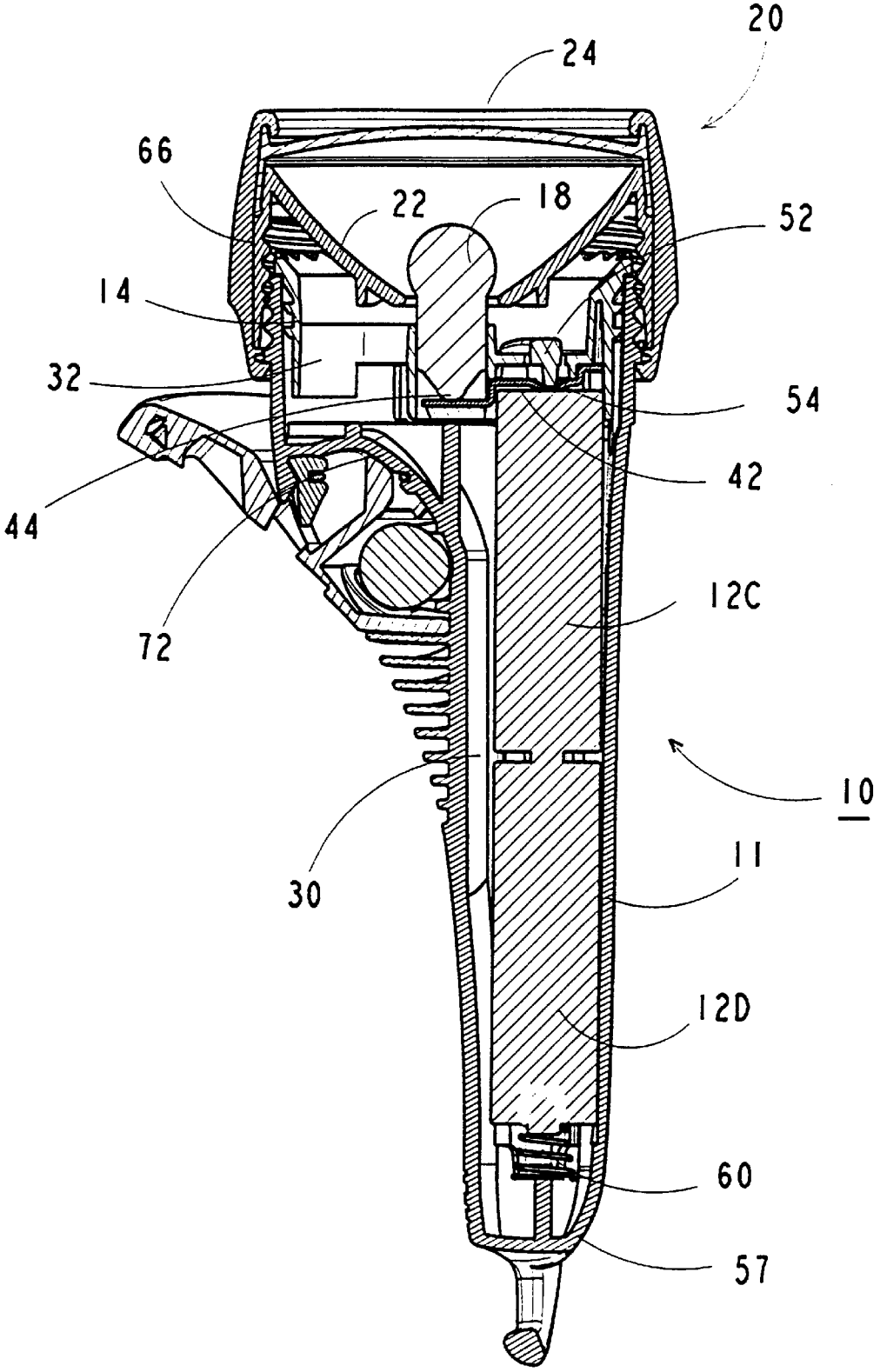
FIG. 7 is a cross-sectional view of the torch according to a cutting line passing through the second contact, and in the lit position of the bulb.
Figure 9:
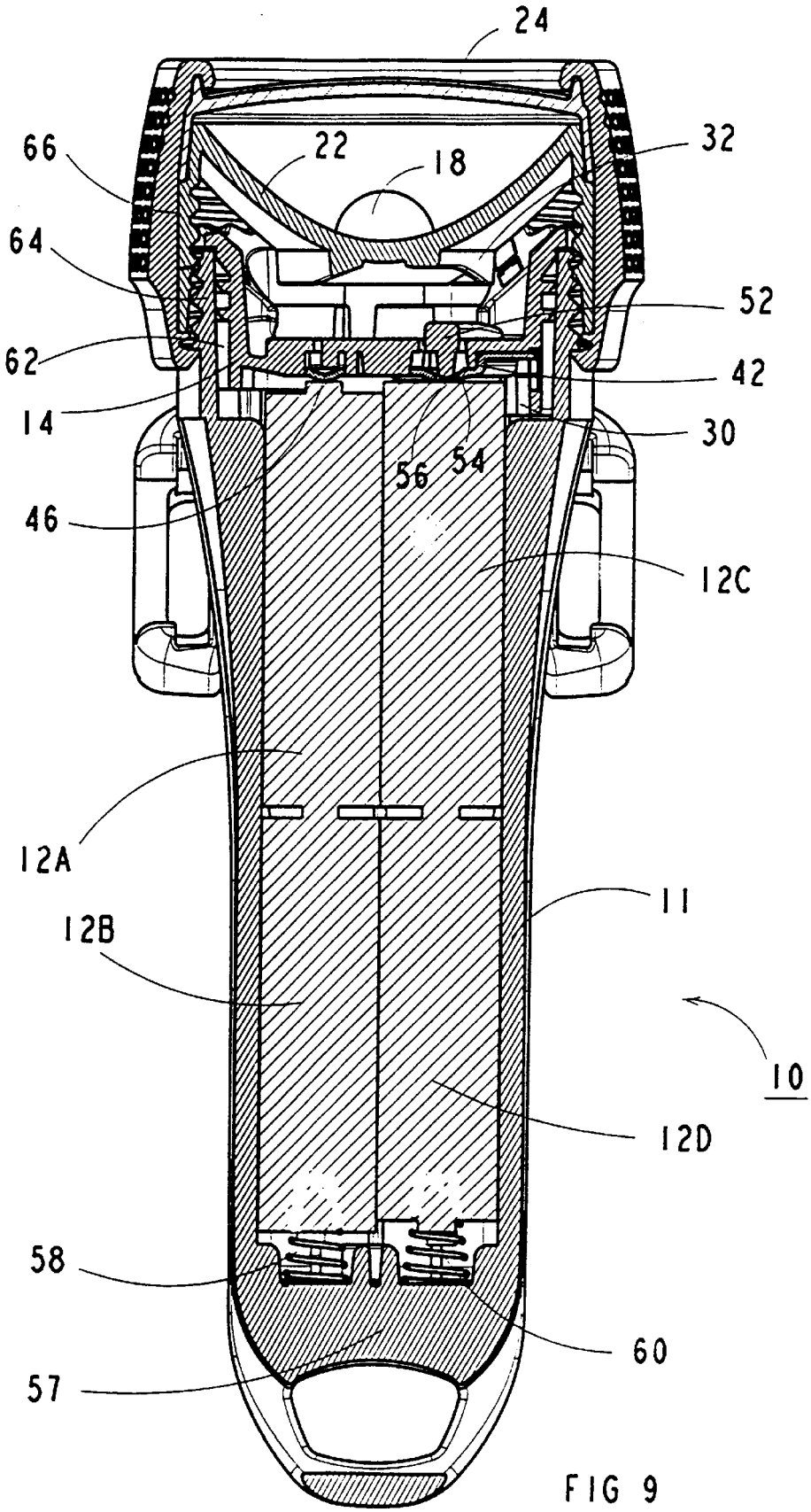
FIGS. 9 and 10 are cross-sectional views according to the axis of the batteries, respectively in the lit position of the bulb and in the unlit position.

The second contact 42 also extends in a radial direction along the face 38 being offset from the first stationary contact 40 by a predetermined angle of about 90°. The second contact 42 is broader than the first one and comprises an orifice 50 in which an operating pushbutton 52 is arranged pivotally mounted on the wall 28 of the body 26. The second contact 42 presents a boss 54 designed to come into engagement with the negative terminal 56 of a second series of two cylindrical batteries 12C, 12D extending parallel to the first series of batteries 12A, 12B in the compartment 30 (FIGS. 7 and 9).

The closed base 57 of the case 11 contains two compression springs 58, 60 electrically connected to one another and on which the two bottom batteries 12B and 12D of the two columns rest. The two springs 58, 60 are achieved by means of a conducting wire enabling the four batteries 12A, 12B, 12C, 12D to be connected in series. Opposite from the base 57, the case 11 comprises a circular housing 62 in which the cylinder 14 is inserted, said housing being bounded by an end 64 with external thread onto which the rotating ring 66 of the visualization cover 20 is screwed (FIG. 1).

Inside the housing 62, the cylinder 14 is mounted with limited rotation and is able to occupy a first rest position allowing the batteries 12A, 12B, 12C, 12D to be fitted or removed, and a second work position commanding lighting of the torch 10. The bulb 18 extends in the axial alignment of the cylinder 14.

Figure 2:
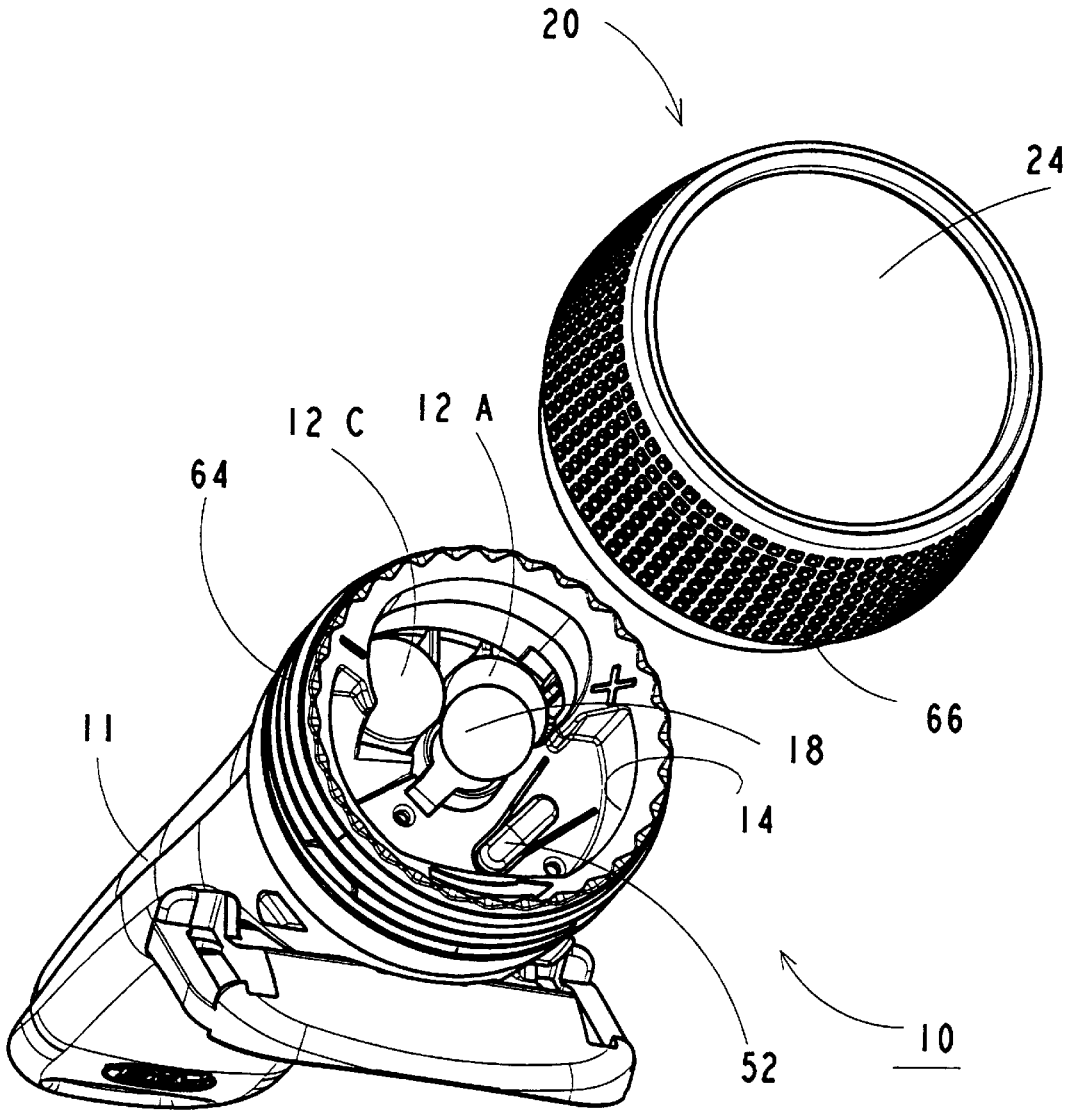
FIG. 2 shows a perspective view of the torch light after fitting of the rotary cylinder, which is in a first rest position.
Figure 3:
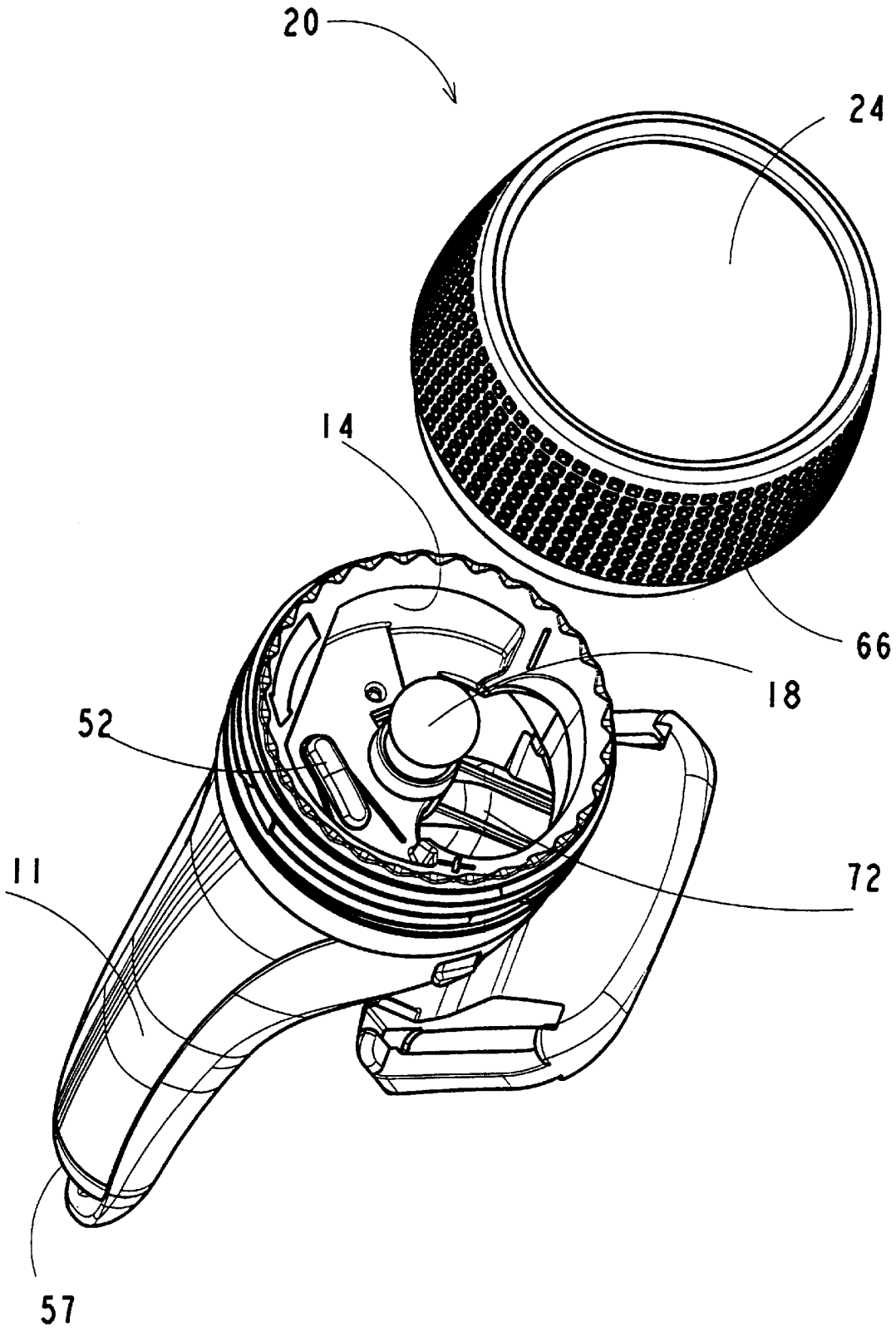
FIG. 3 is an identical view to FIG. 2, with the cylinder represented in the second work position.

The first rest position is represented in FIG. 2, in which the opening 68 of the perforated wall 28 allows access to the compartment 30 to fit or remove the batteries. Switching from the first rest position to the second work position is achieved by a rotational movement of one half-turn of the cylinder 14 exerted manually in the clockwise direction (FIG. 3). This rotational movement of the cylinder 14 is made easier by the presence of an oblique ramp 70 (FIGS. 5 and 6) on the face 38 of the separating wall 28. The reaction of the ramp 70 on the batteries 12A, 12C causes a compression movement of the springs 58, 60 to provide the contact pressure when the protuberance 46 of the first contact 40 and the boss 54 of the second contact 42 respectively reach a position where they are pressing on the positive terminal 48 and the negative terminal 56 of the batteries 12A, 12C. The rotational movement of the cylinder 14 to the second position enables automatic cleaning to be performed by rubbing of the contacts 40 and 42 on the batteries 12A and 12C.

The operating pushbutton 52 is formed by an elastic lever which can be in an inactive position or in an active position depending on the travel of the reflector 22 in translation when rotation of the ring 66 takes place.

In the inactive position (FIG. 7), the pushbutton 52 does not pass through the orifice 50 of the second contact 42 and the electrical supply circuit to the bulb 18 is closed to perform lighting. Rotation of the ring 66 enables the focus to be adjusted to adjust the field of the light beam emitted through the translucent screen 24. Such an adjustment of the light beam is described in detail in the document FR-A-2, 513,740.

Figure 10:
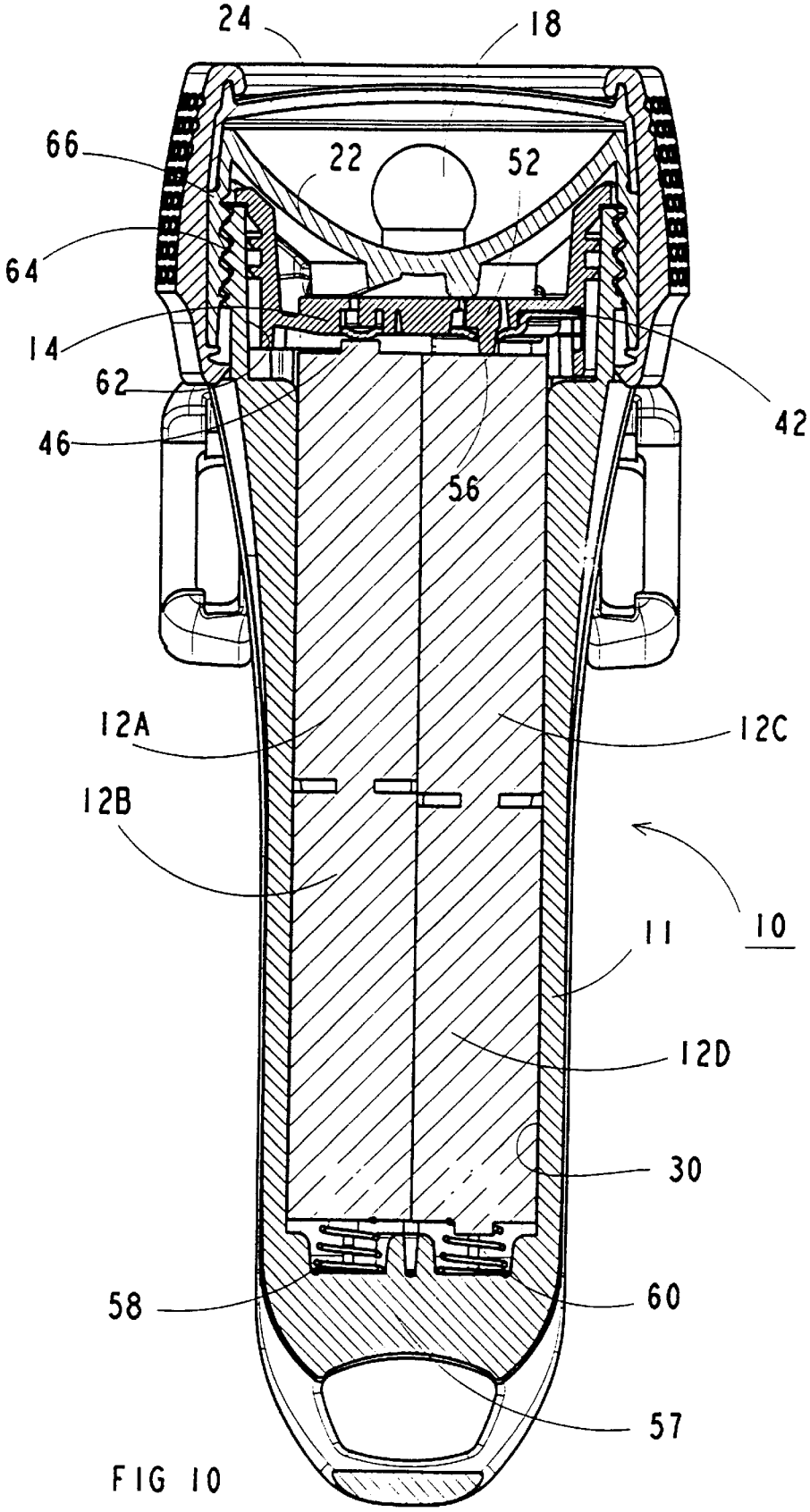

The active position of the pushbutton 52 is obtained at the end of screwing travel of the rotating ring 66 when a stop of the reflector 22 moves the pushbutton 52 through the orifice 50 of the second contact 42 (FIG. 10). The end of the pushbutton 52 causes a slight backward movement according to the axial direction of the batteries 12C, 12D compressing the spring 60. This results in an interruption of the current in the electrical supply circuit to the bulb 18, following the separation of the negative terminal 56 of the battery 12C with the second contact 42 of the cylinder 14.

The two contacts 40, 42 remain fixed and in permanent electrical connection with the metallic base and the insulated terminal 44 of the bulb 18 when the pushbutton 52 is moved to the active position. The switch function is thus shifted to a zone located elsewhere in the compartment 30, following the separation of the battery 12C and of the boss 54 of the second contact 42.

Commissioning and operation of the torch light 10 according to the invention are as follows:

The torch 10 is assembled in the plant with the cylinder 14 inserted in the housing 62 provided at the upper part of the insulating case 11. The bulb 18 is screwed into the insulating socket 34 of the wall 28 and is in electrical connection with the two fixed contacts 40, 42 of the connecting circuit 16 securedly affixed to the cylinder 14. The visualization cover 20 is partially screwed onto the end 64 of the case 11.

To put the torch 10 into operation or to replace used batteries, the user first unscrews the cover 20 and actuates the rotary cylinder 14 to the rest position allowing access to the compartment 30 of the case 11 through the opening 68 of the separating wall 28. The batteries 12A, 12B, 12C, 12D then simply have to be inserted (FIG. 2) via the opening 68 respecting the polarities and the electrical connection in series of the batteries 12A, 12B, 12C, 12D. It can be noted that fitting of the batteries is performed via the front face of the case 11, the base 57 being completely closed and not provided with any closable orifices.

In the first rest position of the cylinder 14, the two contacts 40, 42 of the connecting circuit 16 are not in engagement with the respective terminals of the batteries 12A, 12C, and the bulb 18 is permanently extinguished regardless of the position of the reflector 22 and of the open or closed state of the switch.

Lighting of the bulb 18 is only possible after the cylinder 14 has been moved to the second work position (FIG. 3). The two contacts 40, 42 come to bear on the terminals of the upper batteries 12A, 12C, which causes cleaning of the contacts and energization of the bulb 18. Access to the compartment 30 of the case 11 is then prevented, as the opening 68 of the wall 28 is blocking by an internal protuberance 72 of the case 11. The operating pushbutton 52 of the switch is permanently in the inactive position when the ring 66 of the cover 20 is not coupled to the end 64 of the case 11.

Fitting of the cover 20 is achieved by screwing the ring 66 onto the end 64, and movement of the reflector 22 in translation to a predetermined intermediate position enables the field of the light beam to be focused. The stop of the reflector 22 does not come into engagement with the pushbutton 52 and the switch remains closed due to the holding of the battery 12C urged against the second contact 42 by the return action of the spring 60 (FIG. 7).

FIG. 8 shows an identical view to that of FIG. 7 but with a cross section along the first contact 40, which remains permanently in engagement with the battery 12A.

FIG. 9 is a view of the torch 10 with an axial section through all the batteries 12A, 12B, 12C, 12D of the two columns. The switch is in the closed state and the two contacts 40, 42 are pressing on the two upper batteries 12A, 12C.

With reference to FIG. 10, the switch is switched to the open state at the end of screwing travel of the ring 66. The stop of the reflector 22 pushes the pushbutton 52 through the orifice 50 of the second contact 42 and moves the batteries 12C, 12D downwards against the return force of the spring 60. This results in an insulation gap between the second contact 42 and the negative terminal of the battery 12C, with interruption of the supply circuit to the bulb 18. In this end of travel position, the bulb is extinguished.

Opening of the switch by actuating the pushbutton 52 is performed appreciably in the axis of the battery 12C by the passage of the pushbutton 52 through the orifice 50 of the second contact 42.

The case 11 could naturally be made of metallic material, notably aluminum based. The polarity of the batteries 12A and 12C at the level of the contacts 40, 42 can naturally be reversed, provided that electrical connection of all the batteries in series is preserved.

We claim:

1. An electric torch light, comprising:

a case;

a direct current source including a plurality of batteries housed in a first compartment of the case;

a connecting circuit for electrical connection of a bulb, including first and second supply contacts electrically connected with the current source by a switch;

a cover including a reflector and a transparent screen for emission of a light beam coming from the bulb when the switch is closed; and a cylinder inserted within a circular housing at a front part of the case supporting the bulb and the connecting circuit and rotatable between a first position allowing access to the first compartment for insertion or removal of the batteries, and a second position to energize the bulb and block access to the first compartment, wherein the cylinder includes a ramp which contacts the batteries when the cylinder is rotated to the second position and moves respective terminals of opposite polarities of said batteries into engagement with the first contact and the second contact.

2. The torch light according to claim 1, further comprising: a rotary ring affixed to the cover, wherein the cylinder includes a pushbutton operating the switch of the electrical connecting circuit, said pushbutton being movable from an inactive position corresponding to the closed state of the switch when the second contact is bearing against one terminal of one of the batteries, and an active position urging the switch to the open state following separation of said terminal with the second contact;

wherein turning of the rotary ring moves the pushbutton between positions and focuses light from the bulb by moving the reflector and transparent screen relative to the bulb.

3. The torch light according to claim 2, wherein the reflector includes a stop that moves the pushbutton from the inactive position to the active position when the rotary ring of the cover is fully rotated onto the case.

4. The torch light according to claim 2, wherein the first contact and the second contact of the connecting circuit are permanently in electrical connection respectively, with a metallic base and the insulated terminal of the bulb, and the pushbutton is arranged substantially in axial alignment with the batteries placed under the second contact.

5. The torch light according to claim 3, wherein the second contact is provided with an orifice allowing the pushbutton to pass through when the pushbutton is urged to the active position by the stop of the reflector.

6. The torch light according to claim 5, wherein in the active position the pushbutton moves the batteries against the return force of a contact pressure spring arranged in a base of the case opposite from the cylinder.

7. The torch light according to claim 2, wherein the circular housing of the cylinder is bounded by a circular end with external threads onto which the rotary ring of the cover, arranged coaxially with respect to the cylinder, is screwed.

8. The torch light according to claim 1, wherein the cylinder is formed by a cylindrical body made of molded insulating material, comprising a perforated intermediate wall separating the first compartment with the batteries from a second compartment housing the bulb and reflector, said wall being provided with an opening allowing access to the first compartment in the first position of the cylinder and after the cover has been removed, and blocking said access when the cylinder is moved to the second work position.

9. The torch light according to claim 8, wherein the first contact and second contact of the connecting circuit are positioned radially with an angular offset on the face of the wall facing to the side of the first compartment.

* * * * *